US008298024B2

(12) United States Patent
Taylor

(10) Patent No.: US 8,298,024 B2
(45) Date of Patent: Oct. 30, 2012

(54) PROPULSION SYSTEM FOR A WATERCRAFT

(75) Inventor: Andrew Bruce Taylor, Stellenbosch (ZA)

(73) Assignee: Cape Advanced Engineering (Proprietary) Limited, Atlantis, Western Cape (ZA)

( * ) Notice: Subject to any disclaimer, the term of this patent is extended or adjusted under 35 U.S.C. 154(b) by 44 days.

(21) Appl. No.: 12/744,908

(22) PCT Filed: Nov. 26, 2008

(86) PCT No.: PCT/IB2008/054963

§ 371 (c)(1), (2), (4) Date: Jun. 29, 2010

(87) PCT Pub. No.: WO2009/069084

PCT Pub. Date: Jun. 4, 2009

(65) Prior Publication Data

US 2010/0311290 A1 Dec. 9, 2010

(30) Foreign Application Priority Data

Nov. 26, 2007 (ZA) ..... 2007/10140

(51) Int. Cl.
*B63H 1/16* (2006.01)

(52) U.S. Cl. ..... 440/67

(58) Field of Classification Search ..... 440/67
See application file for complete search history.

(56) References Cited

U.S. PATENT DOCUMENTS

| | | | | |
|---|---|---|---|---|
| 3,244,135 | A * | 4/1966 | Meyerhoff | 114/166 |
| 4,553,945 | A | 11/1985 | Foster | |
| 5,588,886 | A * | 12/1996 | Davis | 440/67 |
| 6,159,062 | A | 12/2000 | Taylor, Jr. | |
| 6,948,988 | B2 * | 9/2005 | Okabe | 440/61 R |
| 2006/0166571 | A1 | 7/2006 | Norman et al. | |
| 2008/0200081 | A1 * | 8/2008 | Gruenwald | 440/67 |

FOREIGN PATENT DOCUMENTS

| | | | |
|---|---|---|---|
| DE | 883255 | C | 7/1953 |
| DE | 941048 | C | 3/1956 |
| GB | 188717 | A | 11/1922 |
| WO | 96/40550 | A1 | 12/1996 |

* cited by examiner

*Primary Examiner* — Stephen Avila
(74) *Attorney, Agent, or Firm* — Thompson Coburn LLP

(57) ABSTRACT

A propulsion system 10 for a watercraft, comprises a surface-piercing propeller 12, a propeller drive 14, a shroud unit 16 which surrounds the propeller and a mounting arrangement 18 for mounting the propeller and the shroud unit to a watercraft. The shroud unit comprises an inner shroud 31 and an outer shroud 33 which define leading and trailing ends of the shroud unit and which define an air gap between them in the form of a rearwardly-opening annular recess 34. In use, due to sub-atmospheric pressure conditions created behind the trailing edge of the shroud unit as the watercraft travels through water, air is aspirated into the recess below the waterline, forming a curved sheet of air in the water aft of the shroud unit which decouples water flowing within the shroud from water flow externally thereof, thereby decreasing drag induced by the shroud.

40 Claims, 8 Drawing Sheets

PROPULSION SYSTEM FOR A WATERCRAFT

CROSS-REFERENCE TO RELATED APPLICATIONS

The present application claims the benefits of PCT/IB2008/054963, filed Nov. 26, 2008, and South African Application No. 2007/10140, filed Nov. 26, 2007, both of which are entitled "A PROPULSION SYSTEM FOR A WATERCRAFT" and are incorporated herein by reference in their entireties.

FIELD OF INVENTION

This invention relates to a propulsion system for a watercraft.

SUMMARY OF THE INVENTION

According to a first aspect of the invention there is provided a propulsion system for a watercraft, including:

a surface-piercing propeller including at least one propeller blade and defining an axis of rotation;

drive means for driving the propeller;

a shroud unit comprising:

a) an inner shroud member for augmenting propeller thrust, which is configured to surround at least the lower half of the propeller blade tip travel path, the inner shroud member having a leading end disposed adjacent said blade tip travel path and a trailing end which is located rearwardly of the propeller blade tip travel path and which extends transversely relative to the axis of rotation of the propeller;

b) an outer shroud member which is configured to surround the inner shroud member, the outer shroud member having a leading end and a trailing end, the outer shroud member being radially spaced from the inner shroud member so as to define an air gap between the inner and outer shroud members to which air can be delivered, the air gap being open at the trailing ends of the shroud members and closed at the leading ends thereof, the outer shroud member having a hydrodynamic lifting formation located at a lower external side thereof, so as to provide hydrodynamic lift as the watercraft travels through water; and mounting means for mounting the propeller and the shroud unit to the watercraft.

The inner and outer shroud members may be formed integrally with one another, with the air gap being defined by a rearwardly-opening recess defined between the inner and outer shroud members.

The shroud unit may include upper portions which are disposed at a height at which at least part of the upper portions and thus the air gap defined thereby, is disposed above the water level so that the air gap is exposed to the atmosphere thereby to deliver atmospheric air to the air gap when the watercraft travels at its design speed, in use. In another embodiment of the invention, the Applicant envisages that ducted air or exhaust gas may be fed into the air gap.

The propulsion system may include a steering sub-system which is operable to pivot the shroud unit from side to side thereby to interfere with water moving relative to the shroud unit thereby to effect steering of the watercraft. In particular, the steering sub-system may be operable to pivot the shroud unit about a substantially vertical pivot axis. In a particular embodiment of the invention, the steering sub-system may further be operable to pivot the propeller from side to side. In particular, the steering sub-system may be operable to pivot the shroud unit and the propeller simultaneously.

The propulsion system may include a trim control sub-system for tilting the shroud unit in a substantially vertical plane for altering the angle of attack of the shroud unit thereby to effect trimming of the watercraft. In particular, the trim control sub-system may be operable to effect tilting of the shroud unit about a substantially horizontal tilt axis. In a particular embodiment, the trim control sub-system may further be operable to tilt the propeller in said substantially vertical plane. More particularly, the trim control system may be operable to tilt the shroud unit and the propeller simultaneously.

The steering sub-system and the trim control sub-system may be integrated.

The hydrodynamic lifting formation may be in the form of a hydrodynamic profile defined in a lower external surface region of the outer shroud member.

The outer shroud member may include a pair of auxiliary trim hydrofoils which extend laterally outwardly from opposite sides of the outer shroud at positions wherein the trim hydrofoils are submerged when the watercraft travels through water at its design speed.

The inner and outer shroud members may have generally curved configurations so as to conform to and surround at least the lower half of the propeller blade tip path.

In one embodiment, the inner and outer shroud members may have an annular configuration and may as such, surround the entire propeller blade tip travel path.

In another embodiment, the inner and outer shroud members may each have curved channel configurations and may surround substantially the lower half of the propeller blade tip travel path.

The propulsion system may include one or more guide vanes located in front of or rearwardly of the propeller for directing water flow.

According to a second aspect of the invention there is provided a propulsion system for a watercraft, including:

a surface-piercing propeller including at least one propeller blade defining an axis of rotation;

drive means for driving the propeller;

a shroud unit comprising:

a) an inner shroud member for augmenting propeller thrust, which is configured to surround at least the lower half of the propeller blade tip travel path, the inner shroud member having a leading end disposed adjacent said blade tip travel path and a trailing end which extends transversely relative to the axis of rotation of the propeller and which is located rearwardly of the propeller blade tip travel path; and b) an outer shroud member which is configured to surround the inner shroud member, the outer shroud member having a leading end and a trailing end, the outer shroud member being radially spaced from the inner shroud member so as to define an air gap between the inner and outer shroud members, the air gap being open at the trailing ends of the of the shroud members and closed at the leading ends thereof, the shroud members including upper portions which are disposed above the axis of rotation of the propeller at a height at which at least part of the upper portions and thereby the air gap defined thereby, is disposed above the water level so that the air gap is exposed to the atmosphere thereby to deliver atmospheric air to the air gap when the watercraft travels at its design speed, in use; and mounting means for mounting the propeller and the shroud unit to the watercraft.

The inner and outer shroud members may be formed integrally with one another, with the air gap being defined by a rearwardly-opening recess defined between the inner and outer shroud members.

The outer shroud member may have a hydrodynamic lifting formation located at an external side thereof so as to provide hydrodynamic lift as the watercraft travels through water.

The propulsion system may include a steering sub-system which is operable to pivot the shroud unit from side to side thereby to interfere with water moving relative to the shroud unit thereby to effect steering of the watercraft. In particular, the steering sub-system may be operable to pivot the shroud unit about a substantially vertical pivot axis. In a particular embodiment of the invention, the steering sub-system may further be operable to pivot the propeller from side to side. In particular, the steering sub-system may be operable to pivot the shroud unit and the propeller simultaneously.

The propulsion system may include a trim control sub-system for tilting the shroud unit in a substantially vertical plane for altering the angle of attack of the shroud unit thereby to effect trimming of the watercraft. In particular, the trim control sub-system may be operable to effect tilting of the water flow directing device about a substantially horizontal tilt axis. In a particular embodiment of the invention, the trim control sub-system may be operable to tilt the propeller in said substantially vertical plane. More particularly, the trim control sub-system may be operable to tilt the shroud unit and the propeller simultaneously.

The steering sub-system and the trim control sub-system may be integrated.

The hydrodynamic lifting formation may be in the form of a hydrodynamic profile defined in a lower external surface region of the outer shroud member.

The outer shroud member may include a pair of auxiliary trim hydrofoils which extend laterally outwardly from opposite sides of the outer shroud member at positions wherein the trim hydrofoils are submerged when the watercraft travels through water at its design speed.

The inner and outer shroud members may have generally curved configurations so as to conform to and surround at least the lower half of the propeller blade tip path.

In one embodiment, the inner and outer shrouds may have an annular configuration and as such, may surround the entire propeller blade tip travel path.

In another embodiment, the inner and outer shroud members may each have curved channel configurations and may surround substantially the lower half of the propeller blade tip travel path.

The propulsion system may include one or more guide vanes located in front of or rearwardly of the propeller for directing water flow.

The invention extends to a watercraft having the propulsion system defined and described hereinabove, mounted thereto.

The invention also extends to the shroud unit as defined and described hereinabove.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
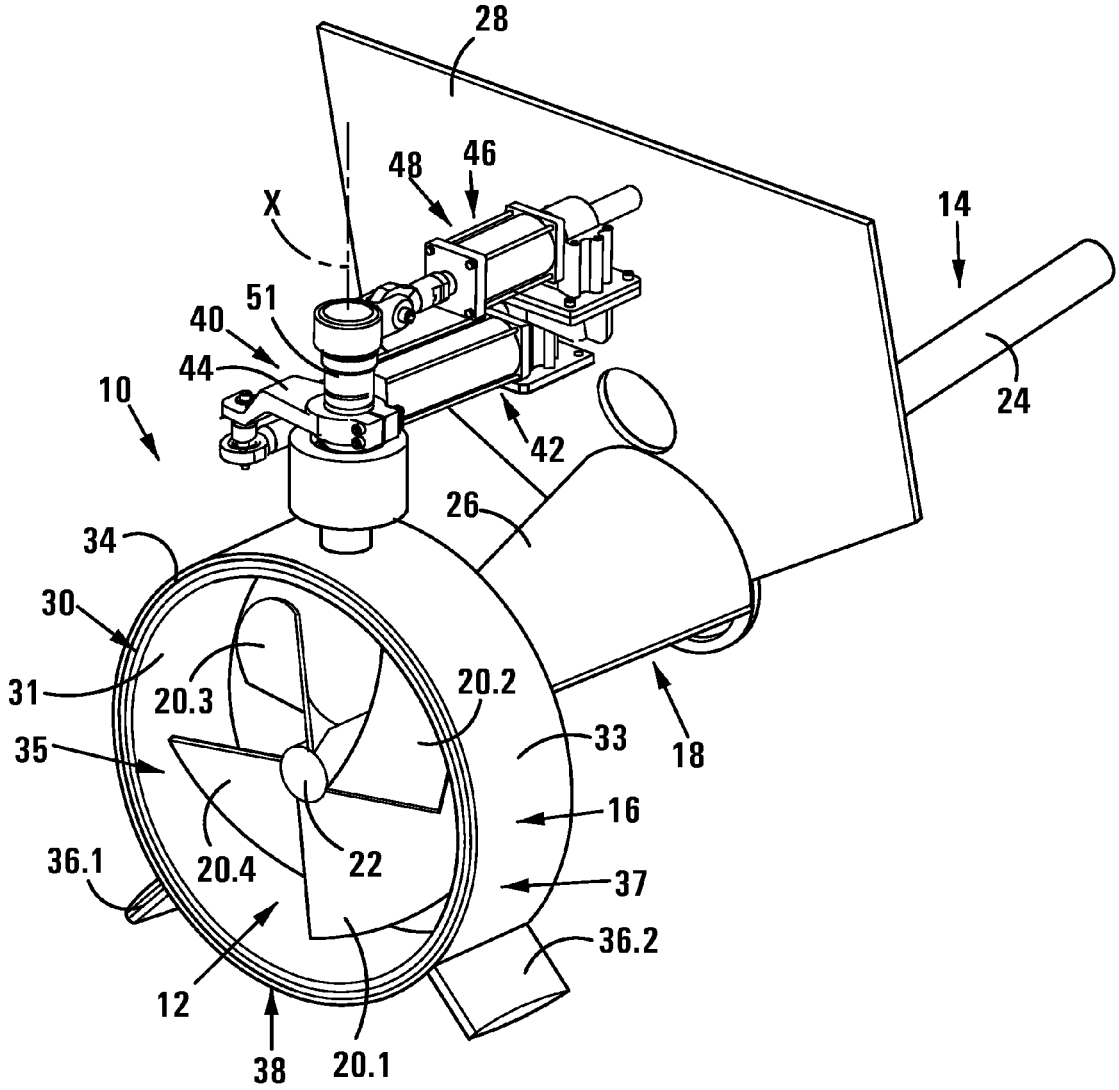
FIG. 1 shows a schematic perspective view of a propulsion system in accordance with the invention.
Figure 2:
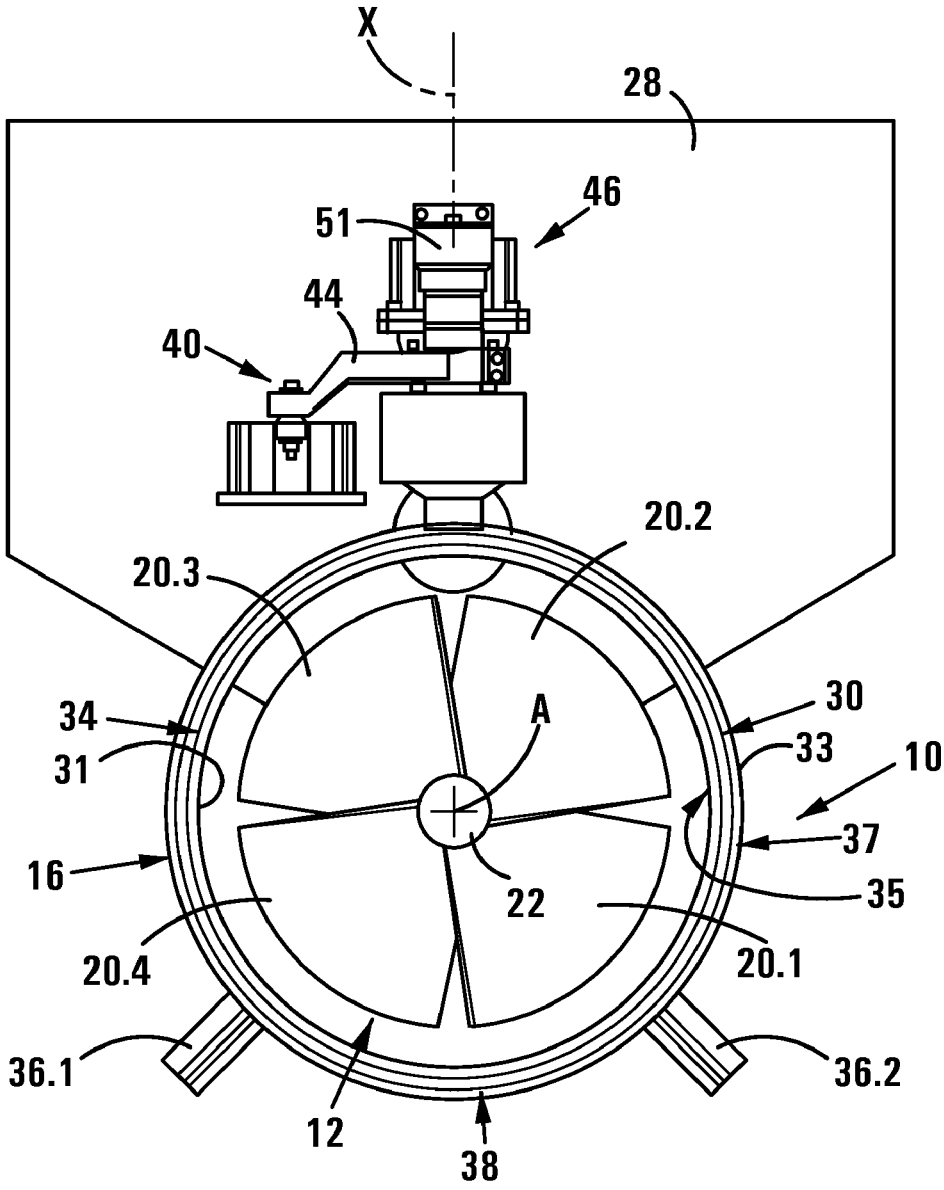
FIG. 2 shows a schematic rear end view of the propulsion system of FIG. 1.
Figure 3:
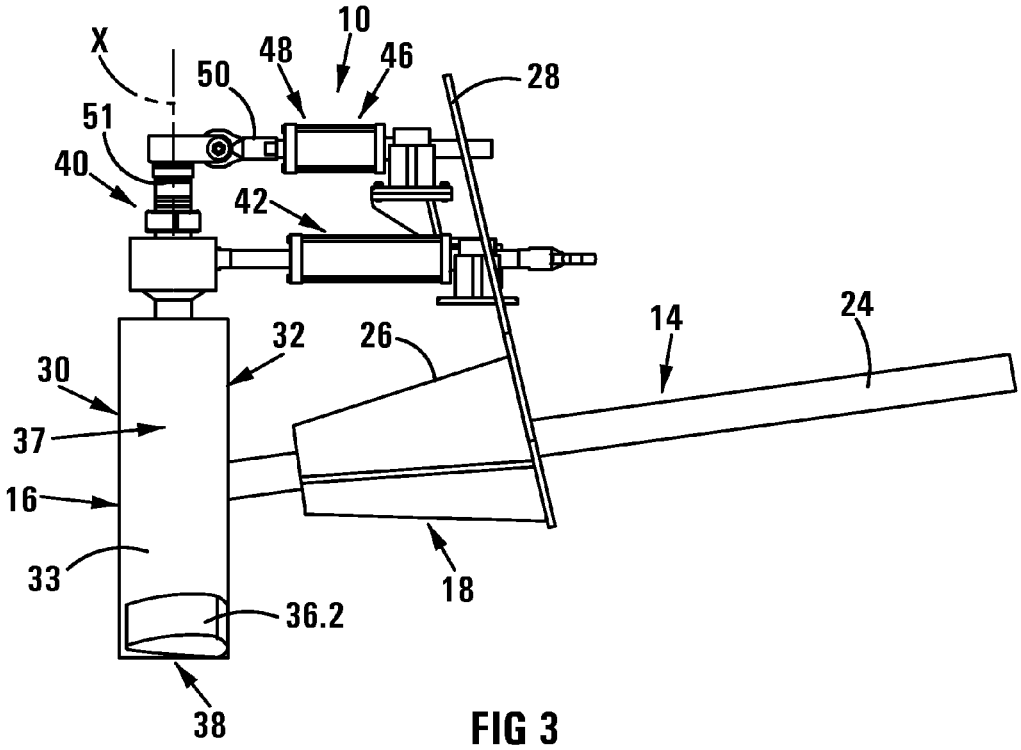
FIG. 3 shows a schematic side view of the propulsion system of FIG. 1.

With reference to FIGS. 1-3 of the drawings, a propulsion system in accordance with the invention, is designated generally by the reference numeral 10. The propulsion system 10 comprises, broadly, a surface-piercing propeller 12, drive means in the form of a drive designated generally by the reference numeral 14 for driving the propeller, a shroud unit 16 which surrounds the propeller and mounting means in the form of a mounting arrangement designated generally by the reference numeral 18 for mounting the propeller 12 and the shroud unit 16 to a watercraft (not shown).

The surface-piercing propeller 12 includes four propeller blades 20.1, 20.2, 20.3 and 20.4 defining curved blade tips which are mounted to a central hub 22 which is rotatable about an axis of rotation "A".

The drive 14 includes a motor (not shown) and a propeller shaft 24 which is driven by the motor which extends through the transom of the watercraft, the propeller 12 being coupled to the propeller shaft 24. As such, the propeller shaft 24 drives and supports the propeller 12. The mounting arrangement 18 includes a propeller shaft bearing housing 26 which carries the propeller 12 and the propeller shaft 24 and transmits forces developed by the propeller to the hull of the watercraft. The mounting arrangement 18 further includes a transom mounting plate 28 which can be attached to the transom of the watercraft and which supports the propeller shaft bearing housing 26.

The shroud unit 16 has an annular configuration and surrounds the propeller 12. The shroud unit 16 has a trailing end 30 and a leading end 32 which is disposed forwardly of the trailing end. The trailing end 30 and the leading end 32 of the shroud are parallel to one another and are disposed in planes perpendicular to the axis of rotation of the propeller 12. More particularly, the trailing end 30 is in the form of a blunt edge and is located rearwardly of the propeller blade tip travel path. The shroud unit 16 comprises an inner shroud member 31 and an integral outer shroud member 33 which surrounds the inner shroud member 31. The inner and outer shroud members have leading and trailing ends which together define the leading and trailing ends of the shroud unit 16. More particularly, the inner shroud member and the outer shroud member define an air gap between them in the form of a rearwardly-opening annular recess 34. It will be appreciated that the inner and outer shroud members are integrated at their leading ends in an arrangement wherein the air gap is closed at their leading ends. The inner shroud member 31 defines an external inner surface 35 and the outer shroud member 33 defines an external outer surface 37 which are acted upon by water when the watercraft is in motion. The shroud unit 16 further includes a pair of auxiliary trim hydrofoils 36.1 and 36.2 which extend laterally outwardly from opposite sides of the outer shroud 33. In particular, the trim hydrofoils 36.1 and 36.2 slope downwardly and extend outwardly from the outer shroud at a position which are at heights wherein the trim hydrofoils are submerged when the watercraft travels through water at its design speed.

The propulsion system includes a steering sub-system 40 which is operable to pivot the shroud unit 16 from side to side thereby to interfere with water moving relative to the shroud unit thereby to effect steering of the watercraft. In particular, the steering sub-system is operable to pivot the shroud unit about a substantially vertical pivot axis "X". The steering sub-system includes a piston/cylinder mechanism 42 which can be actuated remotely from a control unit onboard the watercraft. The steering sub-system 40 includes a control arm 44 to which the piston of the piston/cylinder mechanism 42 is connected, thereby permitting pivotal displacement of the shroud unit 16 to one side when the piston of the piston/cylinder mechanism 42 is extended and to the opposite side when the piston of the piston/cylinder mechanism 42 is retracted. In FIGS. 1-3 of the drawings, the steering sub-system 40 is shown in a neutral position.

The propulsion system also includes a trim control sub-system designated generally by the reference numeral 46. The trim control sub-system 46 includes a piston/cylinder mechanism 48 and a control arm 50 which is acted upon by the piston of the piston/cylinder mechanism. The extension and retraction of the piston of the piston/cylinder mechanism 48 causes the control arm 50 to exert forward and rearward forces on the shroud via a rudder stock 51 to tilt the shroud forwards and rearwards in a substantially vertical plane for altering the angle of attack of the shroud unit thereby to effect trimming of the watercraft. The trim control sub-system 46 thus effects tilting of the shroud unit about a substantially horizontal tilt axis.

The steering sub-system 40 and the trim control sub-system 46 are integrated and thus facilitate both steering and trimming of the watercraft. It will be appreciated that the annular configuration of the shroud unit 16 controls the flow of water through the propeller 12 and is also configured and dimensioned to direct thrust rearwardly of the propeller.

The annular recess 34 defined in the trailing end 30 of the shroud unit allows for the low pressure area created in the wake behind the trailing edge of the shroud unit during forward movement of the watercraft through water, to be ventilated. More particularly, due to the sub-atmospheric condition created behind the trailing edge of the shroud unit, air at atmospheric pressure is aspirated into the recess 34 which is below the water surface via the recess which is disposed above the water surface when the watercraft travels at its design speed. Thus, atmospheric air flows downwardly from that portion of the shroud unit which is above the waterline when the craft is travelling through the water at its design speed, downwardly to the lower half of the shroud unit which is submerged. As the watercraft travels through water, a curved sheet of air is formed in the water aft of the shroud unit. This acts as a viscous decoupler which "decouples" flow within the shroud unit from flow in the area externally of the shroud by forcibly decoupling and separating the water with an air layer. In this manner, the motion of water acted upon by the propeller blade is decoupled from the motion of water below the shroud which is acted upon to generate lift. The viscous decoupler has the benefit of decreasing the drag induced by the shroud. This enables the propeller to achieve higher thrust. Furthermore, substantial lift can be generated by deflecting flow externally of the shroud unit downwards without interfering with the flow or the efficiency of the propeller.

By utilizing the shroud unit 16 to provide the abovementioned combined benefits of shrouding, lifting, steering, trim control and propeller flow guidance, drag acting on those parts of the propulsion system which are submerged when the watercraft is travelling at its design speed, is significantly reduced when compared to conventional watercraft wherein different components with their associated drag coefficients are used to provide similar functions/benefits. The shroud thus enables dynamic control of steering, roll and trim of the watercraft. The trim hydrofoils 36.1 and 36.2 generate lift when moving through water.

Figure 9:
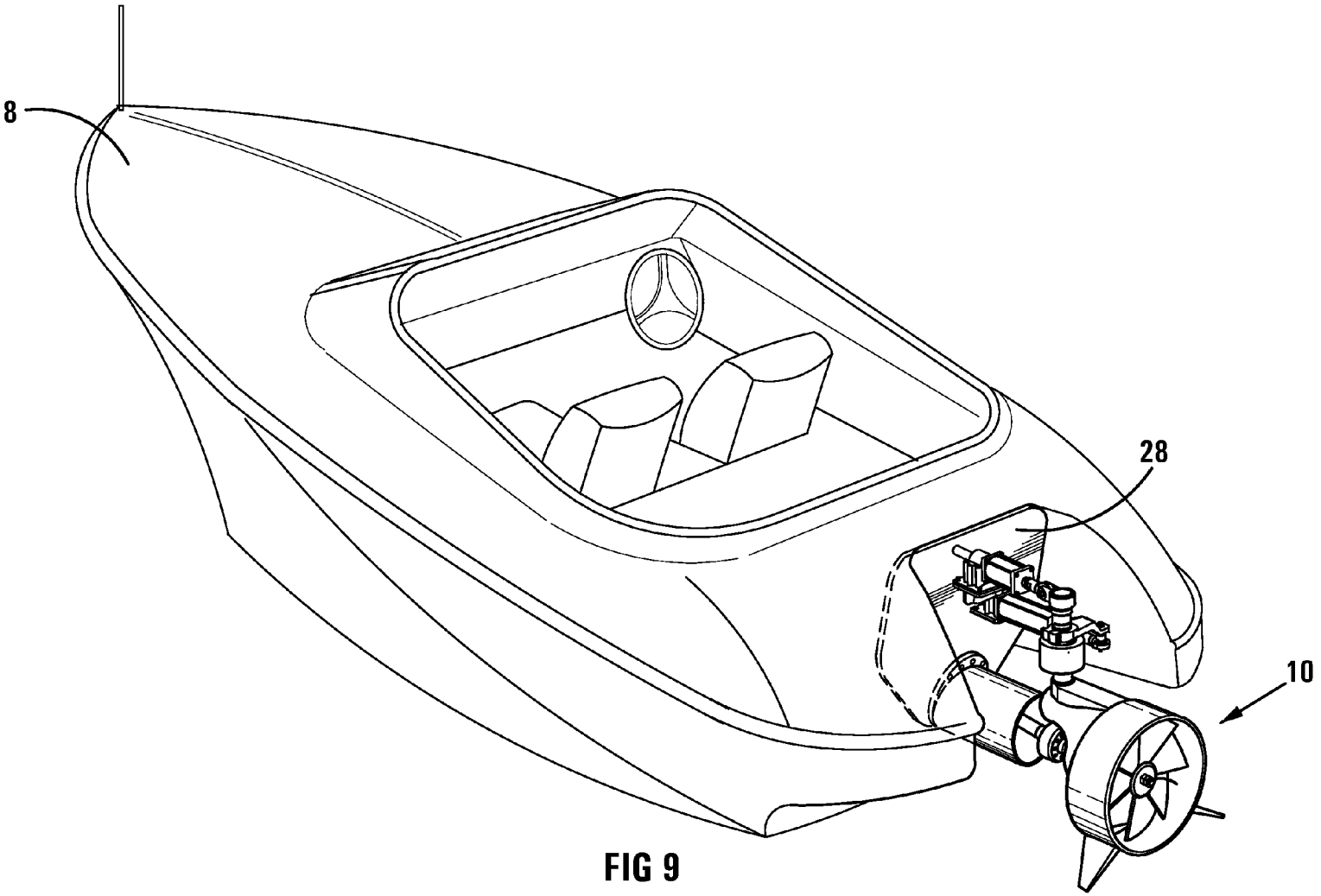
FIG. 9 shows a schematic perspective view of a watercraft having the propulsion system of FIG. 1 mounted thereto.

With reference to FIG. 9, the propulsion system 10 is shown mounted to the transom of a watercraft 8 by means of the transom mounting plate 28.

Figure 4:
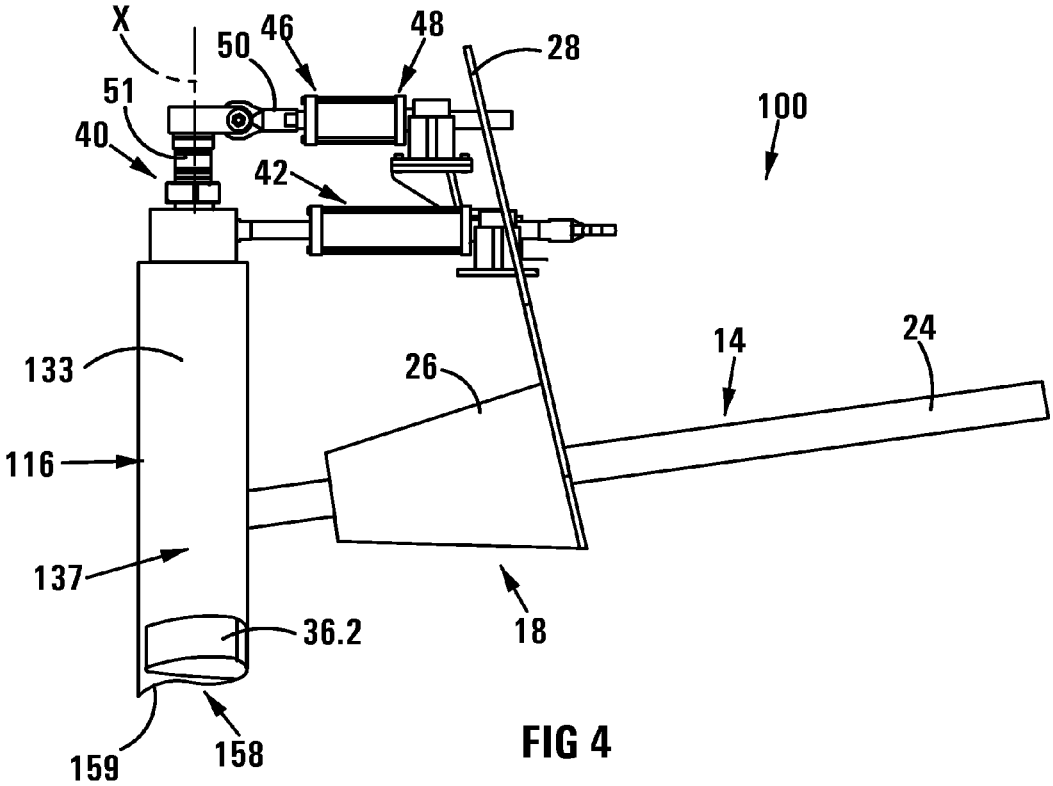
FIG. 4 shows a schematic side view of another embodiment of a propulsion system in accordance with the invention.

With reference to FIG. 4 of the drawings, another embodiment of a propulsion system in accordance with the invention is designated generally by the reference numeral 100. The propulsion system 100 is similar to the propulsion system 10, with the only difference being that the propulsion system 100 includes a shroud unit 116 wherein the outer shroud member 133 has a lower outer surface 158 which defines a hydrodynamic profile 159 similar to that of a hydrofoil, which provides hydrodynamic lift as the watercraft travels through water. As such, the same and/or similar reference numerals are used in FIG. 4 of the drawings to designate those features of the propulsion system 100 which are the same as and/or similar to those of the propulsion system 10.

The hydrodynamic profile 159 permits the shroud to be used as a hydrodynamic lifting device for trim and motion control. The viscous decoupler has the added benefit of decoupling the water flow off the propeller from the water flow off the hydrodynamic profile 159. It will be appreciated that the trim hydrofoils 36.1 and 36.2 act as fences for the hydrodynamic profile 159, thereby increasing the efficiency of the hydrodynamic profile. By dynamically tilting the shroud unit about the tilt axis, the angle of attack and therefore the magnitude of lift created by the hydrodynamic profile 159 and the trim hydrofoils 36.1 and 36.2 is adjusted dynamically to facilitate motion control of the watercraft. It will be appreciated that the trim hydrofoils 36.1 and 36.2 enhance the lift efficiency of the hydrodynamic profile by effectively "fencing" it from the surrounding water flow.

It will be appreciated that apart from being integrated at their leading ends, the inner and outer external surfaces 35, 37 defined by the inner and outer shroud members 31, 33, respectively, are separate from and act independently of one another. The inner surface defined by the inner shroud member 31 is cylindrical and enhances propeller efficiency. The hydrodynamic profile defined by the outer shroud member 33 below the trim hydrofoils, is shaped and disposed to so as to generate optimal lift for trim control of the watercraft. The external surfaces of the outer shroud member above the trim hydrofoils are configured to provide for steering when the shroud unit is articulated, without creating any additional drag. The recess 34 is configured and disposed specifically so as to forcibly separate the water acting on the inner surface 35 defined by the inner shroud member 31 and the external outer surface 37 defined by the outer shroud member 33.

Figure 5:
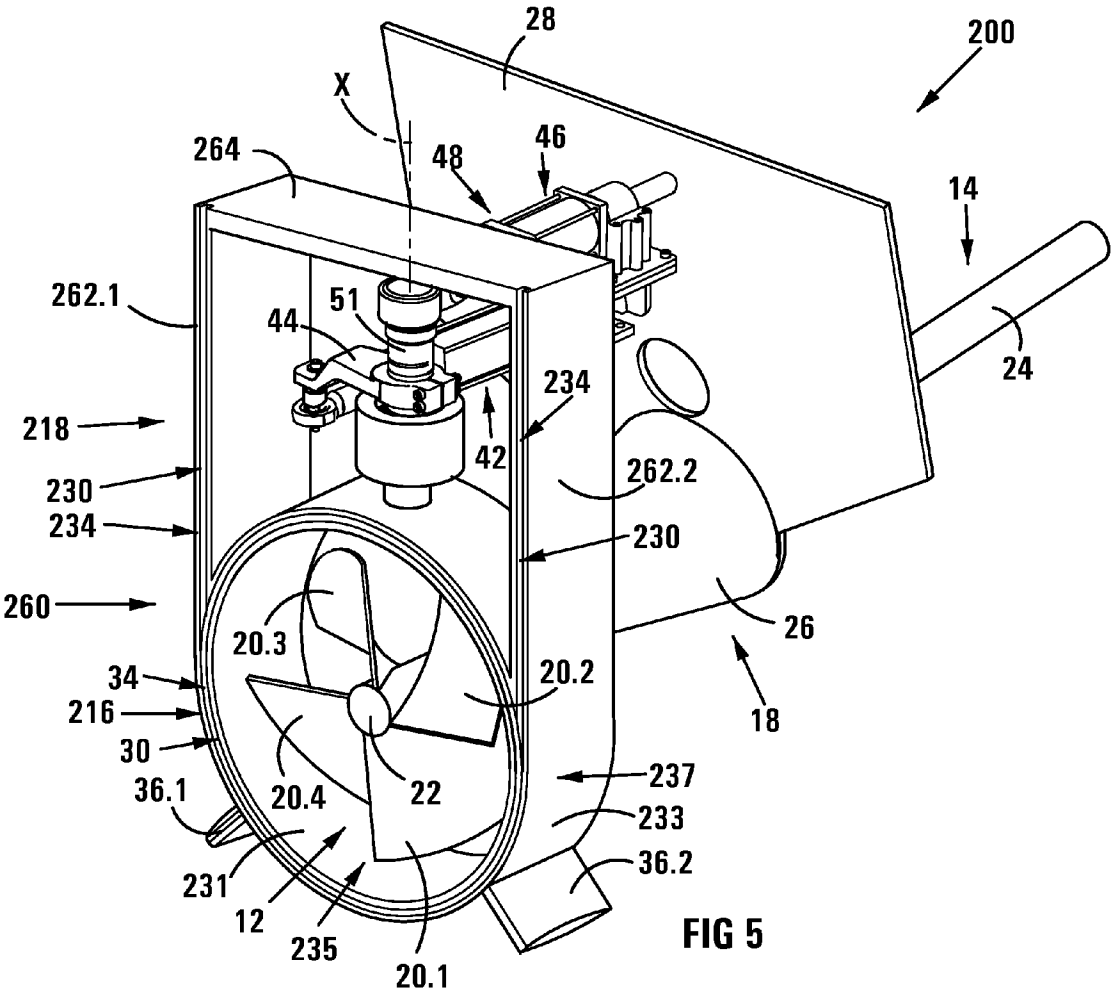
FIG. 5 shows a schematic perspective view as seen from the rear, of yet another embodiment of the propulsion system in accordance with the invention.

With reference to FIG. 5 of the drawings, yet another embodiment system in accordance with the invention is designated generally by the reference numeral 200. The propulsion system 200 is the same as the propulsion system 10, with the only difference being that the propulsion system 200 includes a shroud unit 260 which has a different configuration to the shroud unit 16 of the propulsion system 10. As such, the same and/or similar reference numerals are used in FIG. 5 to designate those features of the propulsion system 200 which are the same as and/or similar to those of the propulsion system 10. More particularly, the shroud unit 260 comprises an annular shroud portion 216 and an inverted U-shaped shroud portion 218 which comprises two upright plates 262.1 and 262.2 and a connecting plate 264 which extends between the upright plates 262.1 and 262.2 at their upper ends. The upright plates 262.1 and 262.2 each have a blunt trailing edge 230 defining a recess 234 which is in flow communication with and which leads into the recess 30 of the annular shroud portion 216.

The recesses 234 defined in the upright plates 262.1 and 262.2 provide for more effective ventilation of the annular recess 30 of the shroud portion 216 as the recesses 234 project a significant distance above the waterline and are thus well ventilated by atmospheric air.

Figure 6:
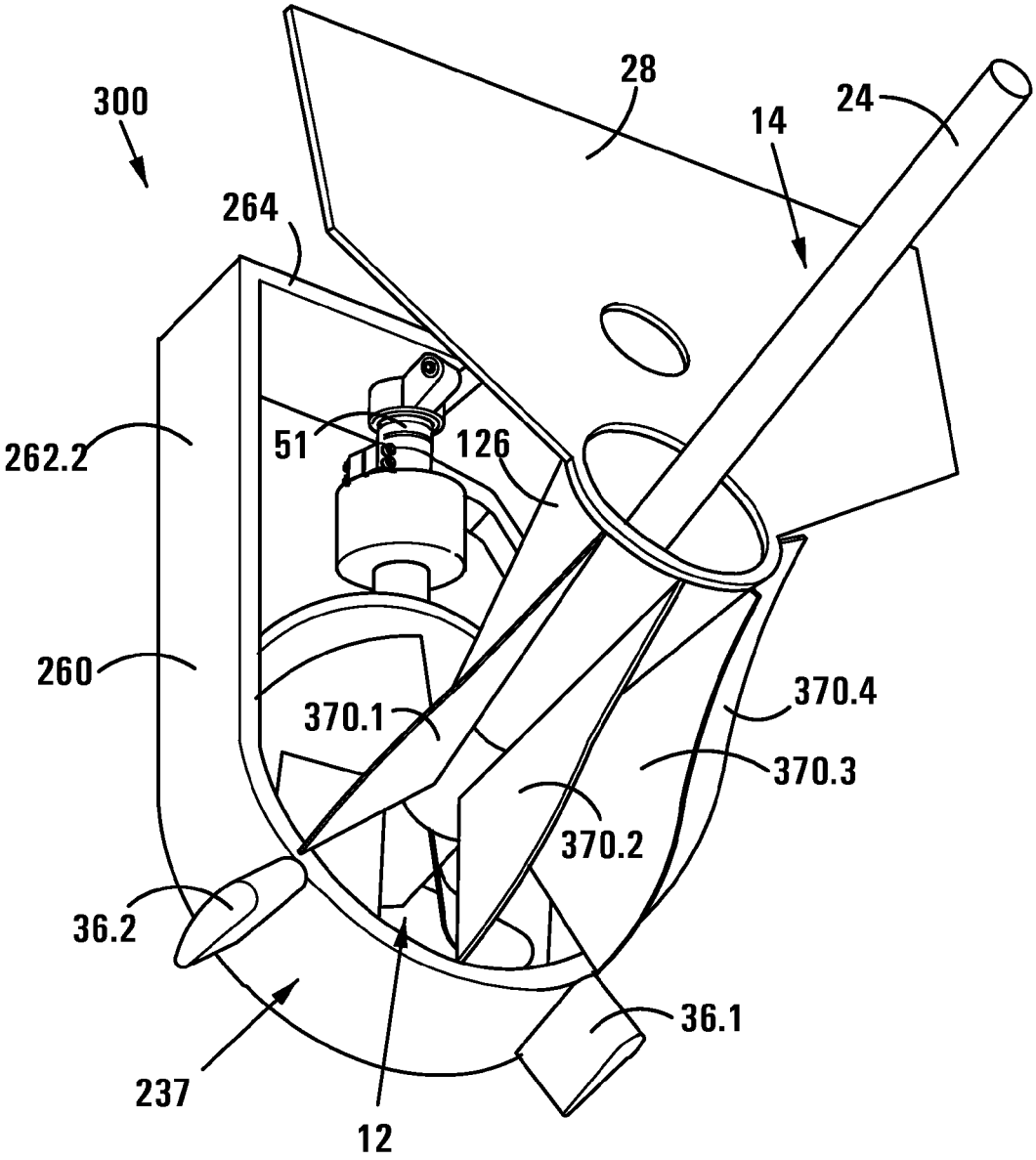
FIG. 6 shows a schematic perspective view as seen from the front, of a further embodiment of a propulsion system in accordance with the invention.

With reference to FIG. 6 of the drawings, a further embodiment of a propulsion system in accordance with the invention, is designated generally by the reference numeral 300. The propulsion system 300 is the same as the propulsion system 200, with the only difference being that the propulsion system 300 includes a housing 126 having four spaced, longitudinally-extending guide vanes 370.1, 370.2, 370.3 and 370.4 which project outwardly therefrom for channeling water flow to the propeller 12, in use. As such, the same and/or similar reference numerals are used in FIG. 6 to designate those features of the propulsion system 300 which are the same as and/or similar to those of the propulsion system 200.

While the shroud unit 260 facilitates longitudinal thrust and motion with reduced friction, it also causes increased, undesirable rotation of the water which may reduce system efficiency. The efficiency can be improved by the use of the guide vanes 370 which in this instance, are located forward of the propeller. It will, however, be appreciated that appropriately-configured guide vanes can be located within the shroud or aft of the propeller for guiding waterflow through the propeller.

Figure 7:
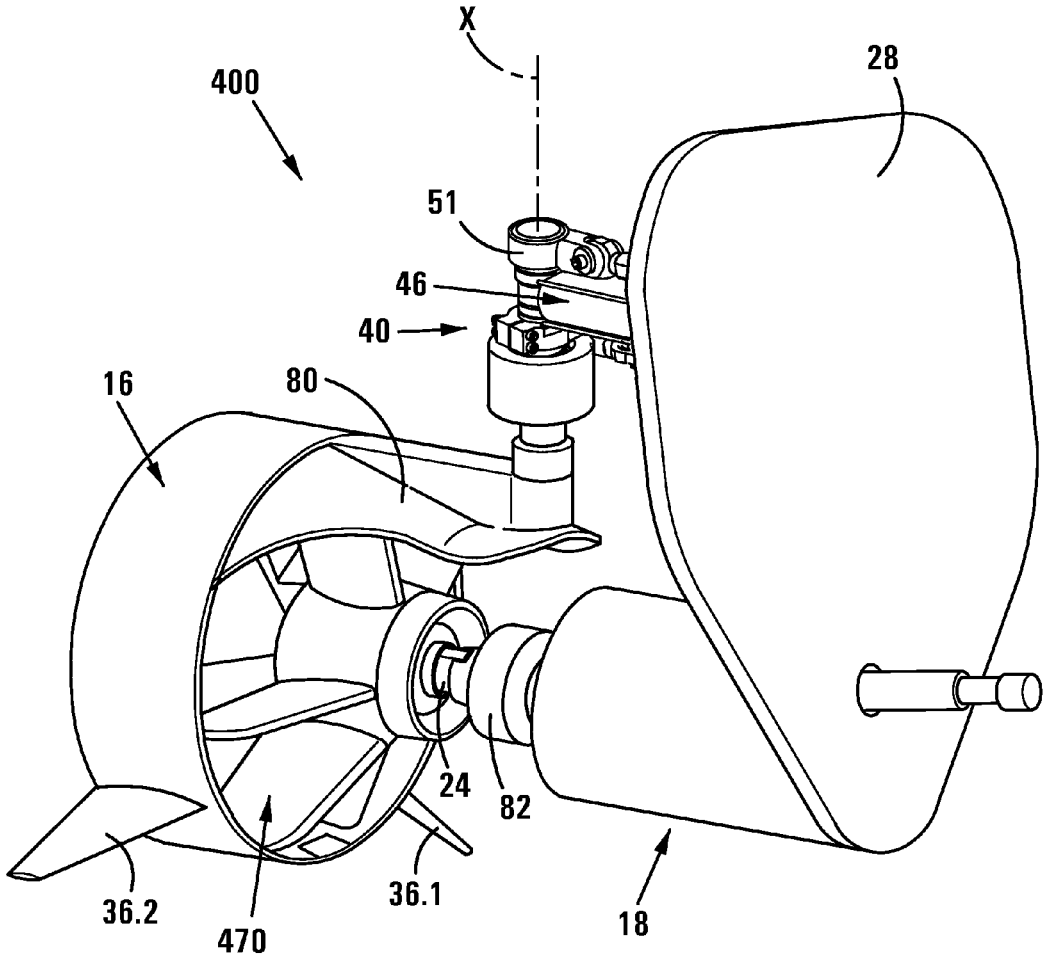
FIG. 7 shows a schematic perspective view as seen from the front, of yet a further embodiment of a propulsion system in accordance with the invention.
Figure 8:
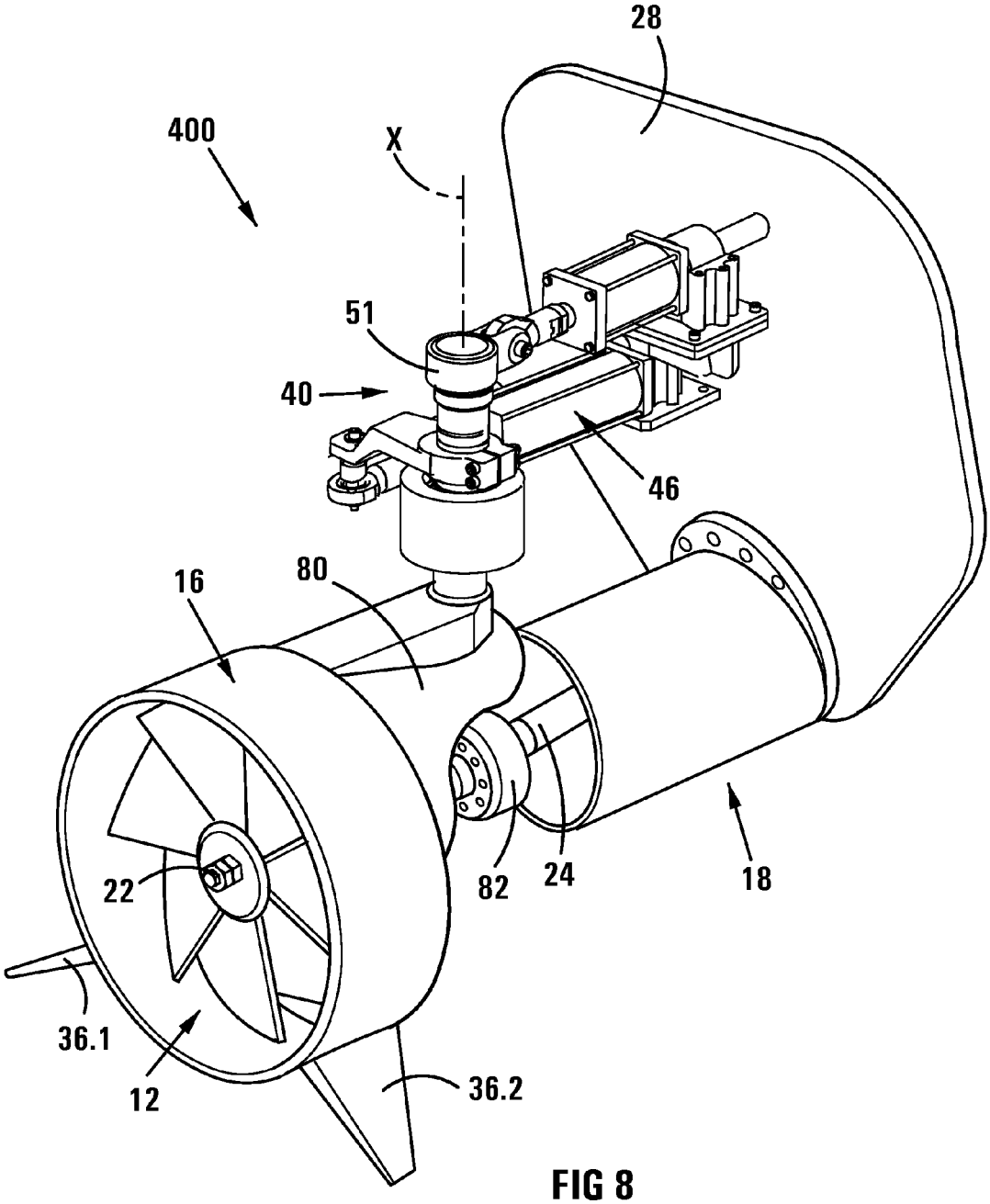
FIG. 8 shows a schematic perspective view as seen from the rear of the embodiment of the propulsion system shown in FIG. 7.

With reference to FIGS. 7 and 8 of the drawings, yet a further embodiment of a propulsion system in accordance with the invention, is designated by the reference numeral 400. The propulsion system 400 is the same as the propulsion system 10, with the only difference being that the propeller 12 is articulated simultaneously with the shroud unit 16 about the vertical pivot axis "X" and a horizontal pivot axis. As such, the same and/or similar reference numerals are used in FIGS. 7 and 8 to designate those features of the propulsion system 400 which are the same as and/or similar to those of the propulsion system 10. The propulsion system 400 includes a forwardly-extending shroud unit extension 80. The rudder stock 51 is pivotally connected to the extension 80. As for the propulsion system 300, the propulsion system 400 includes a guide vane mount 470 which is fixedly mounted to the shroud 16 and which defines a sleeve in which the propeller shaft 24 is rotatably mounted. The guide vane mount 470 includes a number of guide vanes which are located ahead of the propeller 12 for directing water flow to the propeller. The propeller shaft 24 includes a constant velocity joint 82 which is located ahead of the propeller 12 and which permits articulation of the propeller shaft 24. In use, actuation of the steering sub-system 40 and the trim control sub-system 46 provides for articulation of the shroud unit 16 simultaneously with the propeller 12 about the vertical and horizontal axes, while still allowing for normal rotation of the propeller 12.

It will be appreciated that since the propeller and the shroud unit protrude above the water surface when the watercraft is travelling at its design speed, the water propelled by the propeller is displaced backwards and upwards above the waterline. This separation is not possible when a propeller is fully submerged as the water displaced by the propeller will adhere to the law of conservation of volume and will therefore not be able to separate from the surrounding water. Furthermore, since the propeller blades exit and re-enter the water on each rotation, the blades introduce air at atmospheric pressure to the water. The shroud unit has the effect of fencing off this air introduced by the propeller blades, thereby effectively decoupling the aerated water at the inside of the shroud unit from the surrounding water externally of the shroud unit. Without this decoupling, any hydrofoil or other device producing lift adjacent the propeller blades, would be ventilated and thereby disabled from generating lift. The shroud unit thus permits the use of a hydrodynamic lifting device such as the hydrodynamic profile 159 in conjunction with a surface-piercing propeller without the surface-piercing propeller ventilating and thereby disabling the lifting device.

The invention claimed is:

1. A propulsion system for a watercraft, including:

a surface-piercing propeller including at least one propeller blade and defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud unit comprising:

a) an inner shroud member configured and adapted to augment propeller thrust, the inner shroud member surrounding at least the lower half of the tip travel path, the inner shroud member having a leading end disposed adjacent said tip travel path and a trailing end which is located rearwardly of the tip travel path and which extends transversely relative to the axis of rotation of the propeller;

b) an outer shroud member surrounding the inner shroud member, the outer shroud member having a leading end, a trailing end, and a lower external side, the outer shroud member being radially spaced from the inner shroud member so as to define an air gap between the inner and outer shroud members to which air can be delivered, the air gap being open at the trailing ends of the shroud members and closed at the leading ends thereof, the outer shroud member having a hydrodynamic lifting formation located at the lower external side thereof that is configured and adapted to provide hydrodynamic lift when the watercraft travels through water; and a mounting assembly that is configured and adapted to mount the propeller and the shroud unit to the watercraft.

2. The propulsion system as claimed in claim 1, wherein the inner and outer shroud members are formed integrally with one another, with the air gap having a rearwardly-opening recess between the inner and outer shroud members.

3. The propulsion system as claimed in claim 2, wherein the shroud unit includes upper portions which are disposed at a height at which at least part of the upper portions at least part of the air gap are disposed above the lower half of the tip travel path and is configured and adapted to operatively connect the air gap to the atmosphere.

4. The propulsion system as claimed in claim 1, which includes a steering sub-system, and the shroud unit is pivotal relative to the mounting assembly via the steering sub-system.

5. The propulsion system as claimed in claim 4, wherein the steering sub-system is operable to pivot the shroud unit relative to the mounting assembly about a substantially vertical pivot axis.

6. The propulsion system as claimed in claim 5, wherein the steering sub-system is operable to pivot the propeller relative to the mounting assembly.

7. The propulsion system as claimed in claim 6, wherein the shroud unit and the propeller are pivotally fixed relative to each other about the pivot axis.

8. The propulsion system as claimed in claim 7, which includes a trim control sub-system, the shroud unit being pivotable in a substantially vertical plane relative to the mounting assembly via the trim control sub-system.

9. The propulsion system as claimed in claim 8, wherein the shroud unit is pivotable about a substantially horizontal tilt axis relative to the mounting assembly via the trim control sub-system.

10. The propulsion system as claimed in claim 9, wherein the trim control sub-system is configured and adapted to tilt the propeller in said substantially vertical plane relative to the mounting assembly.

11. The propulsion system as claimed in claim 10, wherein the shroud unit and the propeller are pivotally fixed relative to each other about the tilt axis.

12. The propulsion system as claimed in claim 11, wherein the steering sub-system and the trim control sub-system are integrated.

13. The propulsion system as claimed in claim 12, wherein the hydrodynamic lifting formation is in the form of a hydrodynamic profile.

14. A propulsion system for a watercraft, including:

a surface-piercing propeller including at least one propeller blade and defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud unit comprising:

a) an inner shroud member configured and adapted to augment propeller thrust, the inner shroud member surrounding at least the lower half of the tip travel path, the inner shroud member having a leading end disposed adjacent said tip travel path and a trailing end which is located rearwardly of the tip travel path and which extends transversely relative to the axis of rotation of the propeller;

b) an outer shroud member surrounding the inner shroud member, the outer shroud member having a leading end, a trailing end, and a lower external side, the outer shroud member being radially spaced from the inner shroud member so as to define an air gap between the inner and outer shroud members to which air can be delivered, the air gap being open at the trailing ends of the shroud members and closed at the leading ends thereof, the outer shroud member having a hydrodynamic lifting formation located at the lower external side thereof that is configured and adapted to provide hydrodynamic lift when the watercraft travels through water, the outer shroud member including a pair of auxiliary trim hydrofoils which extend laterally outwardly from opposite sides of the outer shroud member at beneath the axis of rotation of the propeller;

a mounting assembly that is configured and adapted to mount the propeller and the shroud unit to the watercraft;

a steering sub-system, the shroud unit being pivotal relative to the mounting assembly via the steering sub-system, the steering sub-system being operable to pivot the shroud unit and the propeller relative to the mounting assembly about a substantially vertical pivot axis, the shroud unit and the propeller being pivotally fixed relative to each other about the pivot axis; and;

a trim control sub-system, the shroud unit and the propeller being pivotable in a substantially horizontal tilt axis relative to the mounting assembly via the trim control sub-system, the shroud unit and the propeller are pivotally fixed relative to each other about the tilt axis, the steering sub-system and the trim control sub-system being integrated, the hydrodynamic lifting formation being in the form of a hydrodynamic profile.

15. The propulsion system as claimed in claim 14, wherein the inner and outer shroud members have generally curved configurations that conform to and surround at least the lower half of the tip travel path of the propeller.

16. The propulsion system as claimed in claim 15, wherein the inner and outer shroud members have an annular configuration wherein the inner and outer shroud members encircle the tip travel path of the propeller.

17. The propulsion system as claimed in claim 15, wherein the inner and outer shroud members each have a curved channel configuration surrounding substantially the lower half of the tip travel path.

18. The propulsion system as claimed in claim 1, which includes one or more guide vanes located one of in front of and rearwardly of the propeller, the guide vanes being configured and adapted to direct water flow.

19. A propulsion system for a watercraft, including:

a surface-piercing propeller including at least one propeller blade defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud, unit comprising:

a) an inner shroud member configured and adapted to augment propeller thrust, the inner shroud member surrounding at least the lower half of the tip travel path, the inner shroud member having a leading end disposed adjacent said tip travel path and a trailing end which extends transversely relative to the axis of rotation of the propeller and which is located rearwardly of the tip travel path; and b) an outer shroud member surrounding the inner shroud member, the outer shroud member having a leading end and a trailing end, the outer shroud member being radially spaced from the inner shroud member so as to define an air gap between the inner and outer shroud members, the air gap being open at the trailing ends of the of the shroud members and closed at the leading ends thereof, the shroud members including upper portions which are disposed above the axis of rotation of the propeller at a height at which at least part of the upper portions and at least part of the air gap are disposed above the lower half of the tip travel path and is configured and adapted to operatively connect the air gap to the atmosphere; and a mounting assembly that is configured and adapted to mount the propeller and the shroud unit to the watercraft.

20. The propulsion system as claimed in claim 19, wherein the inner and outer shroud members are formed integrally with one another, with the air gap having a rearwardly-opening recess between the inner and outer shroud members.

21. The propulsion system as claimed in claim 20, wherein the outer shroud member has a hydrodynamic lifting formation located at an external side thereof that is configured and adapted to provide hydrodynamic lift when the watercraft travels through water.

22. The propulsion system as claimed in claim 20, which includes a steering sub-system, and the shroud unit is pivotal relative to the mounting assembly via the steering sub-system.

23. The propulsion system as claimed in claim 22, wherein the steering sub-system is operable to pivot the shroud unit relative to the mounting assembly about a substantially vertical pivot axis.

24. The propulsion system as claimed in claim 23, wherein the steering sub-system is operable to pivot the propeller relative to the mounting assembly.

25. The propulsion system as claimed in claim 24, wherein the shroud unit and the propeller are pivotally fixed relative to each other about the pivot axis.

26. The propulsion system as claimed in claim 22, which includes a trim control sub-system, the shroud unit being pivotable in a substantially vertical plane relative to the mounting assembly via the trim control sub-system.

27. The propulsion system as claimed in claim 26, wherein the shroud unit is pivotable about a substantially horizontal tilt axis relative to the mounting assembly via the trim control sub-system.

28. The propulsion system as claimed in claim 27, wherein the trim control sub-system is configured and adapted to tilt the propeller in said substantially vertical plane relative to the mounting assembly.

29. The propulsion system as claimed in claim 28, wherein the shroud unit and the propeller are pivotally fixed relative to each other about the tilt axis.

30. The propulsion system as claimed in claim 29, wherein the steering sub-system and the trim control sub-system are integrated.

31. The propulsion system as claimed in claim 21, wherein the hydrodynamic lifting formation is in the form of a hydrodynamic profile.

32. A propulsion system for a watercraft, including:

a surface-piercing propeller including at least one propeller blade defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud unit comprising:

a) an inner shroud member configured and adapted to augment propeller thrust, the inner shroud member surrounding at least the lower half of the tip travel path, the inner shroud member having a leading end disposed adjacent said tip travel path and a trailing end which extends transversely relative to the axis of rotation of the propeller and which is located rearwardly of the tip travel path; and b) an outer shroud member surrounding the inner shroud member, the outer shroud member having a leading end and a trailing end, the outer shroud member being radially spaced from the inner shroud member so as to define an air gap between the inner and outer shroud members, the air gap being open at the trailing ends of the shroud members and closed at the leading ends thereof, the shroud members including upper portions which are disposed above the axis of rotation of the propeller at a height at which at least part of the upper portions and at least part of the air gap are disposed above the lower half of the tip travel path and is configured and adapted to operatively connect the air gap to the atmosphere, the outer shroud member including a pair of auxiliary trim hydrofoils which extend laterally outwardly from opposite sides of the outer shroud member at positions beneath the axis of rotation of the propeller, the inner and outer shroud members being formed integrally with one another, the air gap having a rearwardly-opening recess between the inner and outer shroud member, the outer shroud member having a hydrodynamic lifting formation in the form of a hydrodynamic profile located at an external side of the shroud that is configured and adapted to provide hydrodynamic lift when the watercraft travels through water; and a mounting assembly that is configured and adapted to mount the propeller and the shroud unit to the watercraft.

33. The propulsion system as claimed in claim 32, wherein the inner and outer shroud members have generally curved configurations that conform to and surround at least the lower half of the tip travel path of the propeller.

34. The propulsion system as claimed in claim 33, wherein the inner and outer shroud members have an annular configuration wherein the inner and outer shroud members encircle the tip travel path of the propeller.

35. The propulsion system as claimed in claim 33, wherein the inner and outer shroud members each have a curved channel configuration surrounding substantially the lower half of the tip travel path.

36. The propulsion system as claimed in claim 19, which includes one or more guide vanes located one of in front of and rearwardly of the propeller, the guide vanes being configured and adapted to direct water flow.

37. A watercraft including the propulsion system as claimed in claim 1.

38. A watercraft including the propulsion system as claimed in claim 19.

39. A propulsion system for a watercraft, including:

a surface-piercing propeller including at least one propeller blade and defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud unit comprising:

a) an inner shroud member configured and adapted to augment propeller thrust, the inner shroud member surrounding at least the lower half of the tip travel path, the inner shroud member having a leading end disposed adjacent said tip travel path and a trailing end which is located rearwardly of the tip travel path and which extends transversely relative to the axis of rotation of the propeller;

b) an outer shroud member surrounding the inner shroud member, the outer shroud member having a leading end, a trailing end, and a lower external side, the outer shroud member being radially spaced from the inner shroud member so as to define an air gap between the inner and outer shroud members to which air can be delivered, the air gap being open at the trailing ends of the shroud members and closed at the leading ends thereof, the outer shroud member including a pair of auxiliary trim hydrofoils which extend laterally outwardly from opposite sides of the outer shroud member at beneath the axis of rotation of the propeller; and a mounting assembly that is configured and adapted to mount the propeller and the shroud unit to the watercraft.

40. A propulsion system for a watercraft, including:

a surface-piercing propeller including at least one propeller blade defining an axis of rotation, the propeller blade having a tip that rotates with the propeller about a tip travel path, the tip travel path having an upper half and a lower half;

a drive shaft operatively connected to the propeller in a manner such that the drive shaft is configured and adapted to rotate the propeller about an axis of rotation;

a shroud unit comprising:

a) an inner shroud member configured and adapted to, augment propeller thrust, the inner shroud member surrounding at least the lower half of the tip travel path, the inner shroud member having a leading end disposed adjacent said tip travel path and a trailing end which extends transversely relative to the axis of rotation of the propeller and which is located rearwardly of the tip travel path; and b) an outer shroud member surrounding the inner shroud member, the outer shroud member having a leading end and a trailing end, the outer shroud member being radially spaced from the inner shroud member so as to define an air gap between the inner and outer shroud members, the air gap being open at the trailing ends of the shroud members and closed at the leading ends thereof, the shroud members including upper portions which are disposed above the axis of rotation of the propeller at a height at which at least part of the upper portions and at least part of the air gap are disposed above the lower half of the tip travel path and is configured and adapted to operatively connect the air gap to the atmosphere, the outer shroud member including a pair of auxiliary trim hydrofoils which extend laterally outwardly from opposite sides of the outer shroud member at positions beneath the axis of rotation of the propeller; and a mounting assembly that is configured and adapted to mount the propeller and the shroud unit to the watercraft.

* * * * *